US009790880B2

(12) United States Patent
Ito et al.

(10) Patent No.: US 9,790,880 B2
(45) Date of Patent: Oct. 17, 2017

(54) CONTROLLER FOR INTERNAL COMBUSTION ENGINE

(71) Applicant: Toyota Jidosha Kabushiki Kaisha, Toyota-shi, Aichi-ken (JP)

(72) Inventors: Kenta Ito, Nisshin (JP); Keiichi Myojo, Okazaki (JP); Yukihiro Okabe, Seto (JP); Keigo Ishihara, Fuji (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 92 days.

(21) Appl. No.: 14/856,018

(22) Filed: Sep. 16, 2015

(65) Prior Publication Data

US 2016/0097337 A1 Apr. 7, 2016

(30) Foreign Application Priority Data

Oct. 3, 2014 (JP) ..... 2014-204908

(51) Int. Cl.
*F02N 11/08* (2006.01)
*F02D 41/02* (2006.01)
(Continued)

(52) U.S. Cl.
CPC ..... *F02D 41/065* (2013.01); *F02D 41/0295* (2013.01); *F02D 41/126* (2013.01);
(Continued)

(58) Field of Classification Search
CPC ..... F02N 11/0814; F02N 11/007; F02N 11/0844; F02N 11/0829; F02N 11/0833; F02N 11/084; F02N 2200/026; F02D 41/12; F02D 41/123; F02D 41/04; F02D 41/06; F02D 41/0295; F02D 41/126; F02D 41/065; F02D 41/042; F02D 41/18;
(Continued)

(56) References Cited

U.S. PATENT DOCUMENTS 6,148,611 A * 11/2000 Sato ..... F02D 31/008 123/680
6,173,569 B1 * 1/2001 Kusada ..... B60K 6/24 180/65.235
(Continued)

FOREIGN PATENT DOCUMENTS

JP 2000-054826 A 2/2000
JP 2002-327640 A 11/2002
(Continued)

*Primary Examiner* — Lindsay Low
*Assistant Examiner* — George Jin
(74) *Attorney, Agent, or Firm* — Dinsmore & Shohl LLP

(57) ABSTRACT

An internal combustion engine mounted on a vehicle includes an exhaust passage provided with a catalyst. A controller for the internal combustion engine includes a processor. The processor is configured to perform an auto-stopping process on the engine when the engine is idling, perform an auto-restarting process on the engine when the engine is automatically stopped, correct an amount of fuel injected into the engine so that the fuel injection amount of the engine is increased by a correction amount after the auto-restarting process is started, and change the correction amount in accordance with an amount of oxygen stored in the catalyst at a point of time when the auto-stopping process is started.

7 Claims, 5 Drawing Sheets

(51) Int. Cl.

| | |
|---|---|
| ***F02D 41/06*** | (2006.01) |
| ***F02D 41/12*** | (2006.01) |
| *F02D 41/04* | (2006.01) |
| *F02D 41/18* | (2006.01) |

(52) U.S. Cl.
CPC ..... *F02D 41/042* (2013.01); *F02D 41/18* (2013.01); *F02D 2200/0814* (2013.01); *F02N 11/0814* (2013.01)

(58) Field of Classification Search
CPC ..... F02D 2200/0814; F02D 2200/0816; B60K 6/24; B60K 6/445
See application file for complete search history.

(56) References Cited

U.S. PATENT DOCUMENTS

| | | | | |
|---|---|---|---|---|
| 2002/0157651 | A1 | 10/2002 | Hasegawa et al. | |
| 2004/0060535 | A1* | 4/2004 | Osawa ..... | B60W 10/06 123/198 DB |
| 2013/0226439 | A1* | 8/2013 | Hashemi ..... | F02D 41/0295 701/112 |
| 2015/0184605 | A1* | 7/2015 | Matsumura ..... | F02D 41/0295 60/285 |
| 2015/0192081 | A1* | 7/2015 | Ranspach ..... | F02D 41/0295 60/274 |

FOREIGN PATENT DOCUMENTS

| | | | |
|---|---|---|---|
| JP | 2007-239700 | A | 9/2007 |
| JP | 2011-226490 | A | 11/2011 |
| JP | 2014-227937 | A | 12/2014 |

* cited by examiner

CONTROLLER FOR INTERNAL COMBUSTION ENGINE

BACKGROUND OF THE INVENTION

The present invention relates to a controller for an internal combustion engine.

In an internal combustion engine mounted on a vehicle such as an automobile, an exhaust passage is provided with a catalyst for purifying exhaust gas. The catalyst removes NOx, HC, and CO from the exhaust gas flowing through the exhaust passage. To effectively remove the three components from the exhaust gas, the catalyst has an oxygen storage function, and the amount of fuel injected into an internal combustion engine is controlled so that the air-fuel ratio of an air-fuel mixture in a combustion chamber of the engine is adjusted to stoichiometric air-fuel ratio.

The oxygen storage function of the catalyst functions to draw oxygen from the exhaust gas into the catalyst and remove oxygen from the catalyst and emit the oxygen into the exhaust gas in accordance with the concentration of oxygen in the exhaust gas passing through the catalyst.

More specifically, when the oxygen concentration of the exhaust gas is higher than a value obtained when an air-fuel mixture having the stoichiometric air-fuel ratio is combusted in the combustion chamber, that is, when an air-fuel mixture having an air-fuel ratio that is leaner than the stoichiometric air-fuel ratio is combusted in the combustion chamber, the catalyst stores oxygen from the exhaust gas passing through the catalyst due to the oxygen storage function of the catalyst. In contrast, when the oxygen concentration of the exhaust gas is lower than the value obtained when the air-fuel mixture having the stoichiometric air-fuel ratio is combusted in the combustion chamber, that is, when an air-fuel mixture having an air-fuel ratio that is richer than the stoichiometric air-fuel ratio is combusted in the combustion chamber, oxygen is removed from the catalyst and emitted into the exhaust gas due to the oxygen storage function of the catalyst. Hereafter, in the description, the state "leaner than the stoichiometric air-fuel ratio" is simply referred to as "lean", and the state "richer than the stoichiometric air-fuel ratio" is simply referred to as "rich".

The three components, namely, NOx, HC, and CO, may be effectively removed from the exhaust gas when a catalyst has the oxygen storage function and the fuel injection amount of the internal combustion engine is controlled so that the air-fuel ratio of the mixture in the combustion chamber of the engine is adjusted to stoichiometric air-fuel ratio.

More specifically, when the air-fuel ratio of the mixture in the combustion chamber is shifted to a lean state, the oxygen concentration of the exhaust gas passing through the catalyst becomes higher than a value obtained when the stoichiometric air-fuel mixture is combusted in the combustion chamber. Thus, the catalyst stores oxygen from the exhaust gas passing through the catalyst, and NOx is reduced in the exhaust gas. In contrast, when the air-fuel ratio of the mixture in the combustion chamber is shifted to a rich state, the oxygen concentration of the exhaust gas passing through the catalyst becomes lower than the value obtained when the stoichiometric air-fuel mixture is combusted in the combustion chamber. Thus, oxygen is removed from the catalyst and oxidizes HC and CO in the exhaust gas.

Therefore, even when the air-fuel ratio of the mixture in the combustion chamber is shifted between a rich ratio and a lean ratio, for example, as the air-fuel ratio approaches the stoichiometric air-fuel ratio, the three components, namely, NOx, HC, and CO, are effectively removed from the exhaust gas as described above.

In the so-called idling reduction control, an auto-stopping process is performed when the internal combustion engine is idling, and an auto-restarting process is performed when the engine is automatically stopped. When the idling reduction control is executed and fuel injection is stopped after the auto-stopping process is started, the inertially rotating engine sends air to the catalyst through the exhaust passage. Thus, during the inertial rotation of the engine, the amount of oxygen stored in the catalyst increases. Under this condition, the auto-restarting process is performed on the engine.

When the engine runs after the auto-restarting, if the oxygen storage amount of the catalyst is excessively increased, the NOx removal performance of the catalyst deteriorates. In this regard, Japanese Laid-Open Patent Publication No. 2002-327640 discloses a technique in which the amount of fuel injected into the internal combustion engine is increased and corrected after the auto-restarting process is started. When the air-fuel ratio of the mixture in the combustion chamber is adjusted to a rich state through such an increase correction of the fuel injection amount, HC and CO increase in the exhaust gas. To oxidize HC and CO, oxygen is removed from the catalyst. Consequently, the oxygen storage amount of the catalyst is gradually decreased. This limits deteriorations in the NOx removal performance of the catalyst that would occur when the oxygen storage amount is excessively large.

During the inertial rotation of the engine from when the auto-stopping process is started to when the engine is completely stopped (engine rotational speed reaches zero), the total amount of intake air of the engine is generally constant. Thus, in the same manner, during the inertial rotation of the engine, the amount of oxygen stored in the catalyst is generally constant. However, at a point of time when the auto-stopping process is started, the oxygen storage amount of the catalyst would vary in accordance with the engine running state until the auto-stopping process is started and thus is not necessarily constant. This forms variations in the oxygen storage amount of the catalyst at a point of time when the auto-restarting process of the engine is started. Such variations may cause the increase correction amount for the fuel injection amount to have an improper value after the auto-restarting process is started.

After the auto-restarting process is started, when the increase correction amount of the fuel injection is excessively large relative to the oxygen storage amount of the catalyst, the oxidization of HC, CO in the exhaust gas is not completed depending on the removal of oxygen from the catalyst. This deteriorates the performance of the catalyst for removing HC, CO. In contrast, after the auto-restarting process is started, when the increase correction amount of the fuel injection is excessively small relative to the oxygen storage amount of the catalyst, the removal of oxygen, which is used to oxidize HC, CO in the exhaust gas, from the catalyst is decreased. This hinders reduction of the oxygen storage amount in the catalyst and deteriorates the NOx removal performance of the catalyst.

It is an object of the present invention to provide a controller for an internal combustion engine that appropriately maintains the exhaust purification performance of a catalyst by a correction that increases a fuel injection amount when an auto-restarting process is performed on the internal combustion engine.

To achieve the above object, a controller for an internal combustion engine mounted on a vehicle is provided. The engine includes an exhaust passage provided with a catalyst. The controller includes a processor. The processor is configured to perform an auto-stopping process on the engine when the engine is idling, perform an auto-restarting process on the engine when the engine is automatically stopped, correct an amount of fuel injected into the engine so that the fuel injection amount of the engine is increased by a correction amount after the auto-restarting process is started, and change the correction amount in accordance with an amount of oxygen stored in the catalyst at a point of time when the auto-stopping process is started.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of a controller for an internal combustion engine will now be described with reference to FIGS. 1 to 6.

Figure 1:
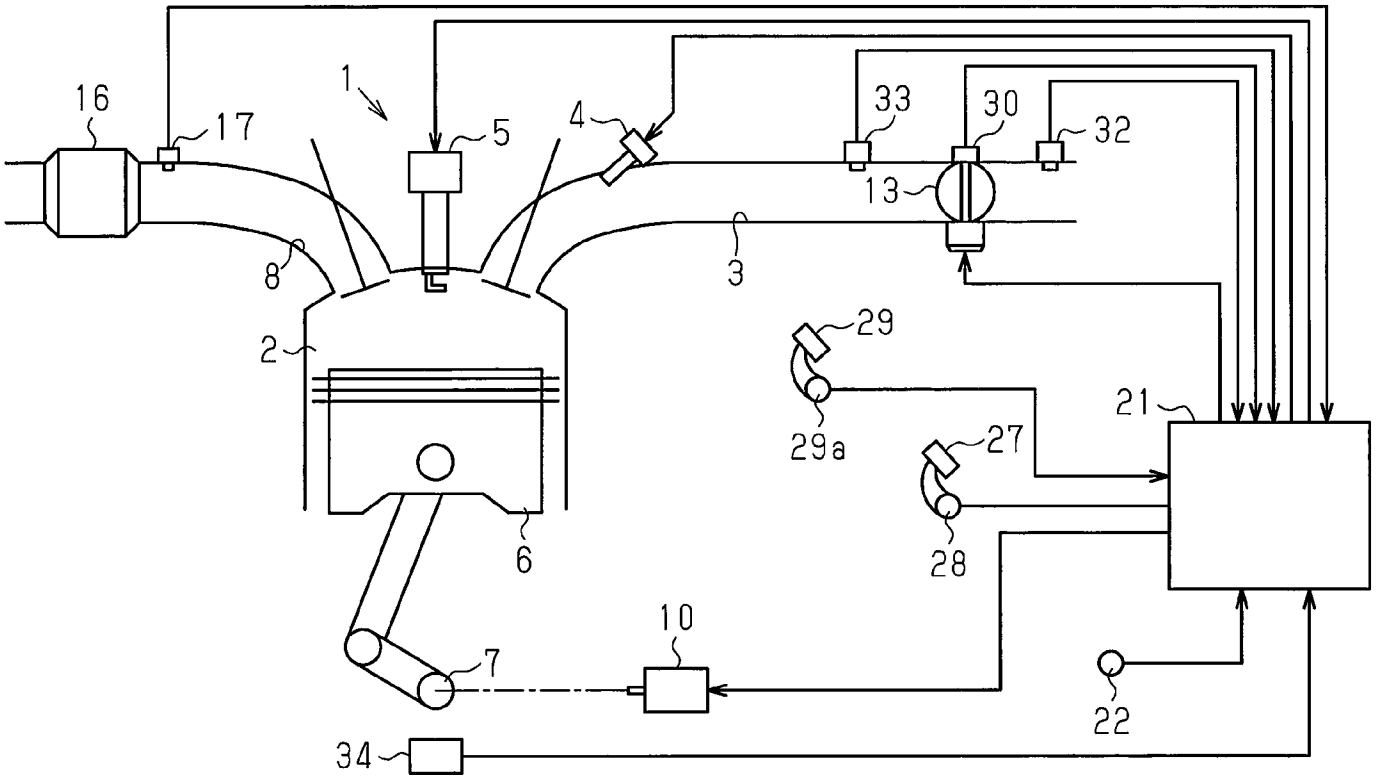
FIG. 1 is a schematic diagram showing an internal combustion engine and a controller for the internal combustion engine.

FIG. 1 shows an internal combustion engine 1 mounted on a vehicle such as an automobile. In the internal combustion engine 1, a throttle valve 13, which can open and close, is arranged in an intake passage 3 connected to a combustion chamber 2. While air is drawn into the combustion chamber 2 through the intake passage 3, fuel is injected from a fuel injection valve 4 and supplied to the combustion chamber 2 through the intake passage 3. The air and the fuel supplied to the combustion chamber 2 form an air-fuel mixture. The air-fuel mixture is ignited and combusted by a spark plug 5. The combustion of the air-fuel mixture in the combustion chamber 2 reciprocates a piston 6 and rotates a crankshaft 7, which is an output shaft of the internal combustion engine 1. The crankshaft 7 is connected to a starter 10, which forcibly rotates (cranks) the crankshaft 7 when the internal combustion engine 1 is started.

Exhaust gas is generated when the air-fuel mixture is combusted in the combustion chamber 2. The exhaust gas is sent out of the combustion chamber 2 to an exhaust passage 8. The exhaust gas, which passes through the exhaust passage 8, is discharged outside after toxic components, namely, HC, CO, NOx, are removed from the exhaust gas by a three-way catalyst of a catalyst converter 16 arranged in the exhaust passage 8. The three-way catalyst has an oxygen storage function to effectively remove the above three components from the exhaust gas. The three components, namely, NOx, HC, CO may be effectively removed from the exhaust gas when the three-way catalyst is provided with the oxygen storage function and the fuel injection amount of the fuel injection valve 4 is controlled so that the oxygen concentration in the exhaust gas passing through the catalyst approaches a value obtained when the stoichiometric air-fuel mixture is combusted.

In the exhaust passage 8, an air-fuel ratio sensor 17, which outputs a signal corresponding to the oxygen concentration of the exhaust gas, is arranged in a portion located upstream from the catalyst converter 16. The air-fuel ratio sensor 17 outputs a linear signal corresponding to the oxygen concentration of the exhaust gas at the upstream side of the catalyst. More specifically, an output signal VAF of the air-fuel ratio sensor 17 becomes smaller as the oxygen concentration of the exhaust gas at the upstream side of the catalyst decreases. When the stoichiometric air-fuel mixture is combusted, the output signal VAF is, for example, "0A" in correspondence with the oxygen concentration X of the exhaust gas. Thus, as the oxygen concentration of the exhaust gas at the upstream side of the catalyst is decreased resulting from combustion of a rich air-fuel mixture (rich combustion), the output signal VAF of the air-fuel ratio sensor 17 becomes smaller than "0A". As the oxygen concentration of the exhaust gas at the upstream side of the catalyst is increased resulting from combustion of a lean air-fuel mixture (lean combustion), the output signal VAF of the air-fuel ratio sensor 17 becomes larger than "0A".

The electrical configuration of the controller for the internal combustion engine 1 will now be described.

The controller includes an electronic control unit 21, which performs various controls of the internal combustion engine 1. The electronic control unit 21 is a microcomputer, a processor, or a control circuitry that includes a CPU performing various calculation processes for the above controls, a ROM storing programs and data necessary for the above controls, a RAM temporarily storing calculation results and the like of the CPU, and input and output ports used to receive and output signals from and to an external device.

The input ports of the electronic control unit 21 are connected to the air-fuel ratio sensor 17 and various sensors such as those described below.

An accelerator position sensor 28 detects a depression amount of an accelerator pedal 27 (accelerator depression amount) that is depressed by an automobile driver.

A brake switch 29*a* detects an ON operation and an OFF operation of a brake pedal 29 that is operated and depressed by the driver.

A throttle position sensor 30 detects the open degree (throttle open degree) of the throttle valve 13, which is arranged in the intake passage 3.

An air flow meter 32 detects the amount of air drawn into the combustion chamber 2 through the intake passage 3.

An intake pressure sensor 33 detects pressure (intake pressure) of the intake passage 3 at a downstream side of the throttle valve 13.

A crank position sensor 34 outputs a signal that is in correspondence with rotation of the crankshaft 7 and used to calculate the engine rotational speed or the like.

The output ports of the electronic control unit 21 are connected to drive circuits (not shown) driving the fuel injection valve 4, the spark plug 5, the starter 10, and the throttle valve 13, respectively.

The electronic control unit 21 recognizes the engine running states, such as the engine rotational speed and the engine load (amount of air drawn into combustion chamber 2 per cycle of internal combustion engine 1), based on detection signals received from the various sensors. The engine rotational speed is obtained based on a detection signal from the crank position sensor 34. The engine load is calculated from the above engine rotational speed and the intake air amount of the internal combustion engine 1 obtained based on detection signals of the accelerator position sensor 28, the throttle position sensor 30, the air flow meter 32, and the like.

The electronic control unit 21 outputs instruction signals to the various drive circuits, which are connected to the output ports, in accordance with the engine running states such as the engine load and the engine rotational speed. In this manner, in the internal combustion engine 1, fuel injection amount control, ignition timing control, intake air amount control, drive control of the starter 10, and the like are performed by the electronic control unit 21.

To effectively purify the exhaust gas with the three-way catalyst of the catalyst converter 16, the fuel injection amount of the internal combustion engine 1 (more specifically, fuel injection valve 4) is controlled so that the oxygen concentration of the exhaust gas passing through the catalyst approaches a value obtained when the stoichiometric air-fuel mixture is combusted. More specifically, the fuel injection amount is increased or decreased based on the output signal VAF of the air-fuel ratio sensor 17 so that the output signal VAF conforms to a value (in this example, "0A") obtained when the air-fuel mixture in the combustion chamber 2 of the internal combustion engine 1 is combusted at the stoichiometric air-fuel ratio. Thus, the air-fuel ratio of the mixture in the combustion chamber 2 of the internal combustion engine 1 is adjusted to approach stoichiometric air-fuel ratio even though shifting between a rich state and a lean state.

Idling reduction control and fuel cut control, which are performed by the electronic control unit 21 to improve the fuel efficiency of the internal combustion engine 1, will now be described respectively.

Idling Reduction Control

Idling reduction control performs an auto-stopping process when the internal combustion engine 1 is idling and an auto-restarting process when the engine 1 is automatically stopped. More specifically, when the internal combustion engine 1 is running and a predetermined auto-stopping condition is satisfied, the engine 1 is automatically stopped. The predetermined auto-stopping condition includes an accelerator pedal depression amount being "zero", the vehicle speed being "zero", the brake pedal 29 being depressed (ON operation performed), and the like. When all of the conditions are satisfied, the auto-stopping condition is determined to be satisfied. When the auto-stopping condition is satisfied, fuel injection from the fuel injection valve 4 is stopped. As a result, the internal combustion engine 1 stops the normal running. Thus, the internal combustion engine 1 inertially rotates for a while before stopping to rotate.

When the rotation of the internal combustion engine 1 is stopped due to the auto-stopping process and an auto-restarting condition is satisfied, the auto-restarting process is performed on the internal combustion engine 1. The auto-restarting condition includes the accelerator pedal depression amount being greater than "zero", the brake pedal 29 being released from the depression (OFF operation performed), and the like. When at least one of the conditions is satisfied, the auto-restarting condition is determined to be satisfied. When the auto-restarting condition is satisfied, the starter 10 is driven to crank the internal combustion engine 1. During the cranking, fuel injection from the fuel injection valve 4 is started. Consequently, the fuel injected from the fuel injection valve 4 and the air in the intake passage 3 are drawn into the combustion chamber 2. When the mixture of the fuel and the air is ignited and combusted by the spark plug 5 in the combustion chamber 2, the internal combustion engine 1 starts the normal running.

Fuel Cut Control

In this control, when the speed of the automobile is decreased, which refers to the accelerator pedal depression amount being "zero (accelerator released)", and the engine rotational speed is higher than or equal to a predetermined value (e.g., value somewhat higher than target idling rotational speed) set in advance, fuel injection from the fuel injection valve 4 is stopped and fuel supply to the internal combustion engine 1 is stopped, that is, fuel cut is executed. Fuel cut is terminated when the accelerator pedal 27 is depressed or the engine rotational speed becomes less than the predetermined value. When fuel cut is terminated, fuel injection from the fuel injection valve 4 is started again, and the internal combustion engine 1 starts the normal running.

The oxygen storage amount OSA of the three-way catalyst in the catalyst converter 16 will now be described.

The oxygen storage amount OSA is obtained as an estimated value of the total amount of oxygen stored in the three-way catalyst by accumulating an oxygen storage amount ΔOSA, which is the amount of oxygen stored in the three-way catalyst within a short time, whenever the short time elapses. When fuel cut is not performed, that is, when the internal combustion engine 1 performs the normal running, the oxygen storage amount ΔOSA per short time is calculated using equation (1) described below.

$$\Delta OSA=(\Delta A/F)\cdot Q\cdot K \quad (1)$$

ΔOSA: oxygen storage amount per short time

ΔA/F: air-fuel ratio difference

Q: fuel injection amount

K: oxygen proportion

The air-fuel ratio difference ΔA/F of equation (1) represents a value obtained by subtracting the stoichiometric air-fuel ratio from an air-fuel ratio obtained based on the output signal VAF of the air-fuel ratio sensor 17. The fuel injection amount Q of equation (1) represents a fuel injection amount of the internal combustion engine 1 that leads to the above air-fuel ratio obtained based on the output signal VAF of the air-fuel ratio sensor 17, that is, an amount of fuel injected from the fuel injection valve 4 per short time. The oxygen proportion K of equation (1) represents the proportion of oxygen contained in the air.

As shown in equation (1), the oxygen storage amount ΔOSA per short time has a positive value when a lean air-fuel ratio is obtained based on the output signal VAF of the air-fuel ratio sensor 17, and has a negative value when a rich air-fuel ratio is obtained based on the output signal VAF of the air-fuel ratio sensor 17. Thus, the oxygen storage amount OSA obtained by accumulating the oxygen storage amount ΔOSA in each short time is gradually decreased when the air-fuel ratio is rich, and gradually increased when the air-fuel ratio is lean.

During fuel cut, that is, when the internal combustion engine 1 is automatically stopped in fuel cut control, the fuel injection amount Q is "zero". In this case, the oxygen storage amount ΔOSA is calculated using equation (2) instead of equation (1).

$$\Delta OSA = GA \cdot KH \quad (2)$$

ΔOSA: oxygen storage amount per short time

GA: intake air amount

KH: coefficient

As shown in equation (2), during fuel cut, the oxygen storage amount ΔOSA per short time is calculated by multiplying the predetermined coefficient KH and the intake air amount GA in the short time. The coefficient KH is set based on the proportion of oxygen in the air and the proportion of oxygen stored in the three-way catalyst. Thus, during fuel cut, the oxygen storage amount OSA of the three-way catalyst is gradually increased by the oxygen storage amount ΔOSA in each short time.

The maximum value of the oxygen storage amount of the three-way catalyst is determined by the size of the catalyst converter 16 or the like. Thus, when the oxygen storage amount OSA, which is obtained by accumulating the oxygen storage amount ΔOSA in each short time, exceeds the maximum value, the maximum value is set to the oxygen storage amount OSA. Thus, the oxygen storage amount OSA will not exceed the maximum value. Here, the oxygen storage amount OSA reaches the maximum value, for example, during fuel cut, in which the amount of oxygen sent to the three-way catalyst increases.

In the idling reduction control, during the inertial rotation of the internal combustion engine 1 from when the auto-stopping process is started to when the engine 1 is completely stopped (engine rotation speed reaches zero), the amount of air sent to the three-way catalyst corresponds to the total amount of the intake air of the engine 1 during the inertial rotation. Since the total amount of the intake air is generally constant during the inertial rotation of the engine 1, the amount of oxygen stored in the three-way catalyst is also generally constant during the inertial rotation of the internal combustion engine 1. In this regard, when the auto-stopping process is started in the idling reduction control, an oxygen amount OX, which corresponds to the total amount of the intake air, is added to the oxygen storage amount OSA. The oxygen amount OX may be determined in advance through experiments or the like.

In the idling reduction control, the control of the fuel injection amount when the auto-restarting process is performed on the automatically stopped internal combustion engine 1 will now be described.

In the idling reduction control, during the inertial rotation of the internal combustion engine 1 from when the auto-stopping process is started to when the engine 1 is completely stopped, air is sent to the three-way catalyst through the exhaust passage 8. Thus, the amount of oxygen stored in the three-way catalyst (oxygen storage amount OSA) increases during the inertial rotation of the internal combustion engine 1. Under such a condition, in which the oxygen amount is increased, the auto-restarting process is performed on the internal combustion engine 1.

When the engine runs after the auto-restarting process and the amount of oxygen stored in the three-way catalyst is excessively increased, the NOx removal performance of the catalyst is deteriorated. Therefore, the fuel injection amount of the internal combustion engine 1 may be increased and corrected after the auto-restarting process is started. When the air-fuel ratio of the mixture in the combustion chamber 2 is adjusted to a rich state through such an increase correction of the fuel injection amount, HC and CO increase in the exhaust gas. To oxidize HC and CO, oxygen is removed from the three-way catalyst. Consequently, the amount of oxygen stored in the three-way catalyst is gradually decreased. This limits deteriorations in the NOx removal performance of the three-way catalyst that would be caused by an excessive oxygen amount.

After the auto-restarting process is started, the increase correction amount for the fuel injection amount (hereafter, referred to as the post-auto-restarting increase amount IFA) may be determined as follows. That is, taking account of the total amount of the intake air being generally constant during the inertial rotation of the engine, from when the auto-stopping process is started and to when the engine 1 is completely stopped, a fixed value H corresponding to the total amount (corresponding to oxygen amount OX) is used as the post-auto-restarting increase amount IFA. The fixed value H is determined in advance through experiments or the like.

However, at a point of time when the auto-stopping process is started, the amount of oxygen stored in the three-way catalyst (oxygen storage amount OSA) would vary in accordance with the engine running state until the auto-stopping process is started and thus is not necessarily constant. For example, when fuel cut is executed before the auto-stopping process is started, at a point of time when the auto-stopping process is started, the amount of oxygen stored in the three-way catalyst (oxygen storage amount OSA) varies in accordance with a length of time from when fuel cut is terminated to when the auto-stopping process is started.

This is related to the correction that increases the fuel injection amount of the internal combustion engine 1 performed during the normal running of the internal combustion engine 1 after fuel cut is terminated so that the oxygen storage amount OSA, which has been increased during fuel cut, is decreased. The increase correction amount of the fuel injection after fuel cut is terminated (hereafter, referred to as the post-fuel cut termination increase amount IFB) may be set to a fixed value that is optimally determined through experiments or the like in advance or a variable value that varies in accordance with the increase in the oxygen storage amount OSA during fuel cut. In the present embodiment, the fixed value is used as the post-fuel cut termination increase amount IFB. During the normal running of the internal combustion engine 1 after fuel cut is terminated, the correction that increases the fuel injection amount by the post-fuel cut termination increase amount IFB gradually decreases the oxygen storage amount OSA. Then, after the oxygen storage amount OSA starts decreasing, when the auto-stopping process of the internal combustion engine 1 is started, the oxygen storage amount OSA at a point of time when the auto-stopping process is started varies in accordance with the length of time from when fuel cut is terminated to when the auto-stopping process is started.

As described above, at the point of time when the auto-stopping process is started, the oxygen storage amount OSA of the three-way catalyst would vary in accordance with the engine running state until the auto-stopping process is started. This forms variations in the amount of oxygen stored in the three-way catalyst (oxygen storage amount OSA) when the auto-restarting process of the internal combustion engine 1 is started. Such variations may cause the increase correction amount of the fuel injection after the auto-restarting process is started (post-auto-restarting increase amount IFA) to have an improper value.

When the post-auto-restarting increase amount IFA is excessively large relative to the amount of oxygen stored in the three-way catalyst, the oxidization of HC, CO in the exhaust gas may not be completed depending on the removal of oxygen from the catalyst. This deteriorates the HC, CO removal performance of the catalyst. In contrast, when the post-auto-restarting increase amount IFA is excessively small relative to the amount of oxygen stored in the three-way catalyst, the removal of oxygen, which is used to oxidize HC, CO in the exhaust gas, from the catalyst is decreased. This may hinder reduction of the amount of oxygen stored in the catalyst and deteriorate the NOx removal performance of the catalyst.

To solve the above problems, based on the oxygen storage amount OSA at a point of time when the auto-stopping process is started, the electronic control unit 21 adjusts the increase correction amount of the fuel injection after the auto-restarting process is started (post-auto-restarting increase amount IFA) as described in (A) and (B) below.

(A) If the oxygen storage amount OSA is greater than "zero" (if oxygen is stored in three-way catalyst) when the auto-stopping process is started, the post-auto-restarting increase amount IFA is increased from that used when the oxygen storage amount OSA is "zero" (when oxygen is not stored in three-way catalyst). When the oxygen storage amount OSA is "zero", it is preferred that the post-auto-restarting increase amount IFA be set to the fixed value H.

(B) As the oxygen storage amount OSA is increased when the auto-stopping process is started, the post-auto-restarting increase amount IFA is increased.

The correction that increases the fuel injection amount after the auto-restarting process is started (correction that increases by the post-auto-restarting increase amount IFA) includes at least one of an increase correction performed when the auto-restarting process is started and a subsequent increase correction. In this example, the two increase corrections are performed.

The electronic control unit 21 functions as a controller that variably sets the increase correction amount of the fuel injection (post-auto-restarting increase amount IFA) based on the oxygen storage amount OSA at a point of time when the auto-stopping process is started, which has been described above. Here, the phrase "at a point of time when the auto-stopping process is started" does not refer only to "at a point of time exactly when the auto-stopping process is started" but also includes a point of time slightly before the auto-stopping process is started.

Figure 2:
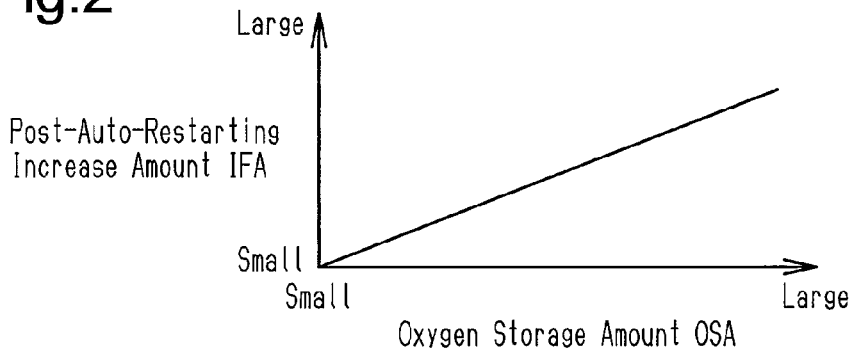
FIG. 2 is a graph showing the relationship between an oxygen storage amount of a three-way catalyst at a point of time when an auto-stopping process is started and an increase correction amount for a fuel injection amount after an auto-restarting process is started.

FIG. 2 is a graph showing changes in the post-auto-restarting increase amount IFA based on variations in the oxygen storage amount OSA at a point of time when the auto-stopping process is started. Even when the oxygen storage amount OSA varies at the point of time when the auto-restarting process is started, the post-auto-restarting increase amount IFA may be adjusted to the value suitable for the oxygen storage amount OSA after the auto-restarting process is started by changing the post-auto-restarting increase amount IFA based on the oxygen storage amount OSA at the point of time when the auto-stopping process is started. Consequently, the correction that increases the fuel injection amount by the post-auto-restarting increase amount IFA allows the exhaust purification performance of the three-way catalyst to be appropriately maintained after the auto-restarting process is started.

This limits deteriorations in the HC, CO removal performance of the three-way catalyst that would occur when the post-auto-restarting increase amount IFA is excessively large relative to the oxygen storage amount OSA and also limits deteriorations in the NOx removal performance of the three-way catalyst that would occur when the post-auto-restarting increase amount IFA is excessively small relative to the oxygen storage amount OSA.

The operation of the controller for the internal combustion engine 1 will now be described with reference to the time chart of FIG. 3 and the flowcharts of FIGS. 4-6.

Figure 3:
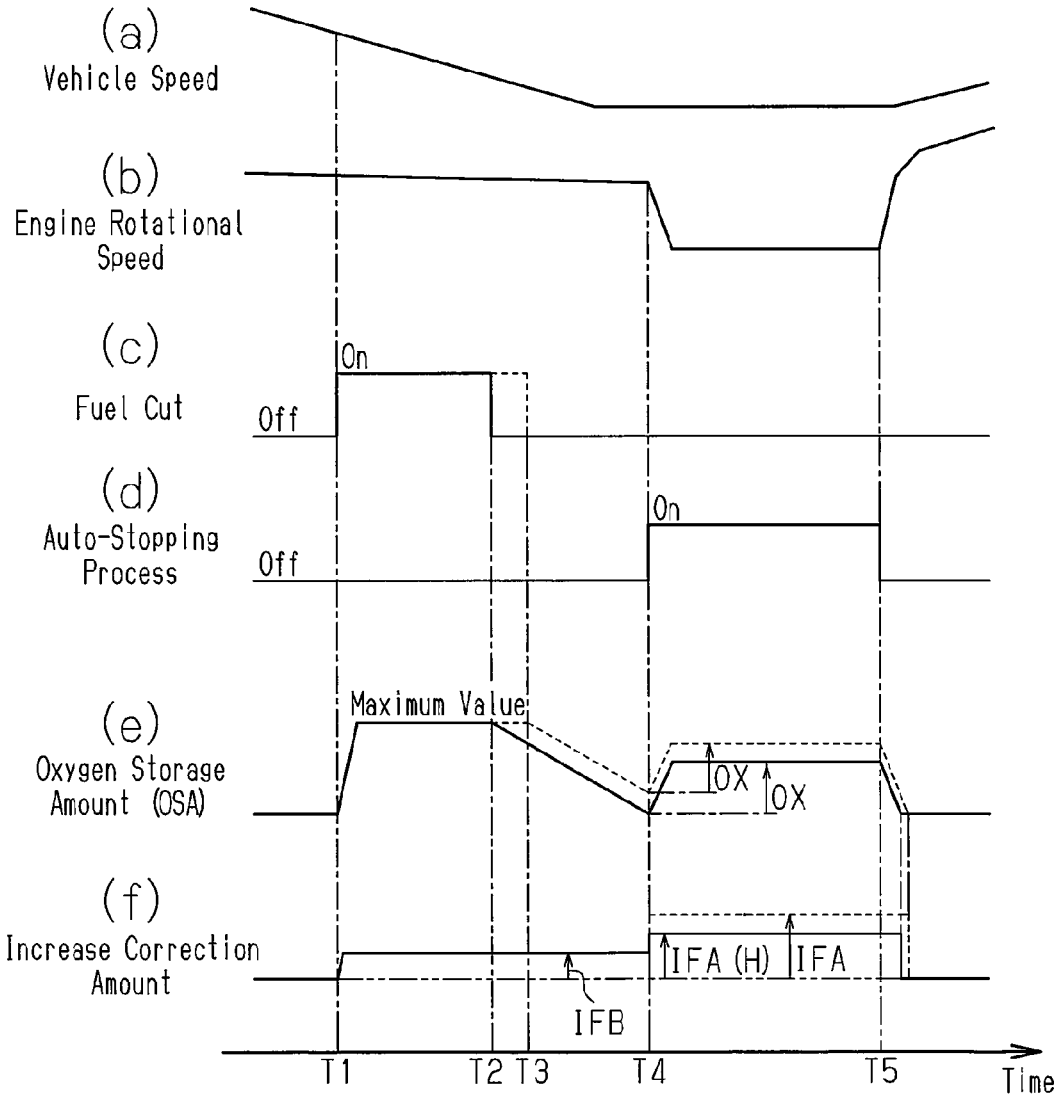
FIG. 3 is a time chart illustrating the operation of the controller for the internal combustion engine in which (a) shows changes in vehicle speed, (b) shows changes in engine rotational speed, (c) shows whether or not fuel cut is executed, (d) shows whether or not the auto-stopping process is performed on the engine, (e) shows changes in the oxygen storage amount of the three-way catalyst, and (f) shows changes in the increase correction amount for the fuel injection amount.

When the vehicle speed is decreased as shown in (a) of FIG. 3 and fuel cut is started at time T1, air drawn into the internal combustion engine 1 is sent to the three-way catalyst through the exhaust passage 8. Thus, during fuel cut, the oxygen storage amount OSA of the three-way catalyst increases, for example, to the maximum value as shown in (e) of FIG. 3 by the solid line subsequent to time T1. Then, when fuel cut is terminated at time T2, the internal combustion engine 1 starts the normal running again when the fuel is injected from the fuel injection valve 4.

As shown in (f) of FIG. 3 by the solid line subsequent to time T1, to decrease the oxygen storage amount OSA, which is increased during fuel cut, the electronic control unit 21 sets the increase correction amount of the fuel injection to the post-fuel cut termination increase amount IFB. As a result, after fuel cut has been terminated and the internal combustion engine 1 starts running again, the fuel injection amount is corrected to be increased by the post-fuel cut termination increase amount IFB. Due to the increase correction, the oxygen storage amount OSA is gradually decreased as shown in (e) of FIG. 3 by the solid line subsequent to time T2. When the oxygen storage amount OSA has started decreasing and the auto-stopping process of the internal combustion engine 1 is started, the oxygen storage amount OSA at time T4, that is, the oxygen storage amount OSA when the auto-stopping process is started, varies in accordance with the length of time from when fuel cut is terminated to when the auto-stopping process is started.

For example, when the termination of fuel cut is delayed from time T2 to time T3, the length of time becomes shorter from when fuel cut is terminated to when the auto-stopping process is started at time T4. Accordingly, the decrease in the oxygen storage amount OSA is delayed as indicated by the broken line in (e) of FIG. 3. Thus, for example, when fuel cut is terminated at time T2 and the oxygen storage amount OSA reaches "zero" by time T4, at which the auto-stopping process is started, if the termination of fuel cut is delayed to time T3, the oxygen storage amount OSA is greater than "zero" at time T4, when the auto-stopping process is started. At time T4, when the auto-stopping process is started, the oxygen storage amount OSA increases as the length of time becomes shorter from when fuel cut is terminated to when the auto-stopping process is started.

When the oxygen storage amount OSA varies at time T4, at which the auto-stopping process is started, the oxygen storage amount OSA also varies after the auto-restarting process of the automatically stopped internal combustion engine 1 is started at time T5. In this example, subsequent to time T5, the oxygen storage amount OSA changes as indicated by the solid line and the broken line in (e) of FIG. 3. Thus, the value of the oxygen storage amount OSA varies. As described above, even when the oxygen storage amount OSA tends to largely vary at time T5, at which the auto-restarting process is started, the increase correction amount of the fuel injection may be adjusted to the value suitable for the corresponding oxygen storage amount OSA subsequent to time T5, at which the auto-restarting process is started.

This is because the post-auto-restarting increase amount IFA is adjusted, as described in (A) and (B), based on the oxygen storage amount OSA at time T4, at which the auto-stopping process is started, as shown in FIG. 2. Consequently, the increase correction amount shown in (f) of FIG. 3 changes as indicated by the solid line and the broken line subsequent to time T4. As a result, subsequent to time T5, at which the auto-restarting process is started, the increase correction amount (post-auto-restarting increase amount IFA) is set to the value suitable for the corresponding oxygen storage amount OSA.

Figure 4:
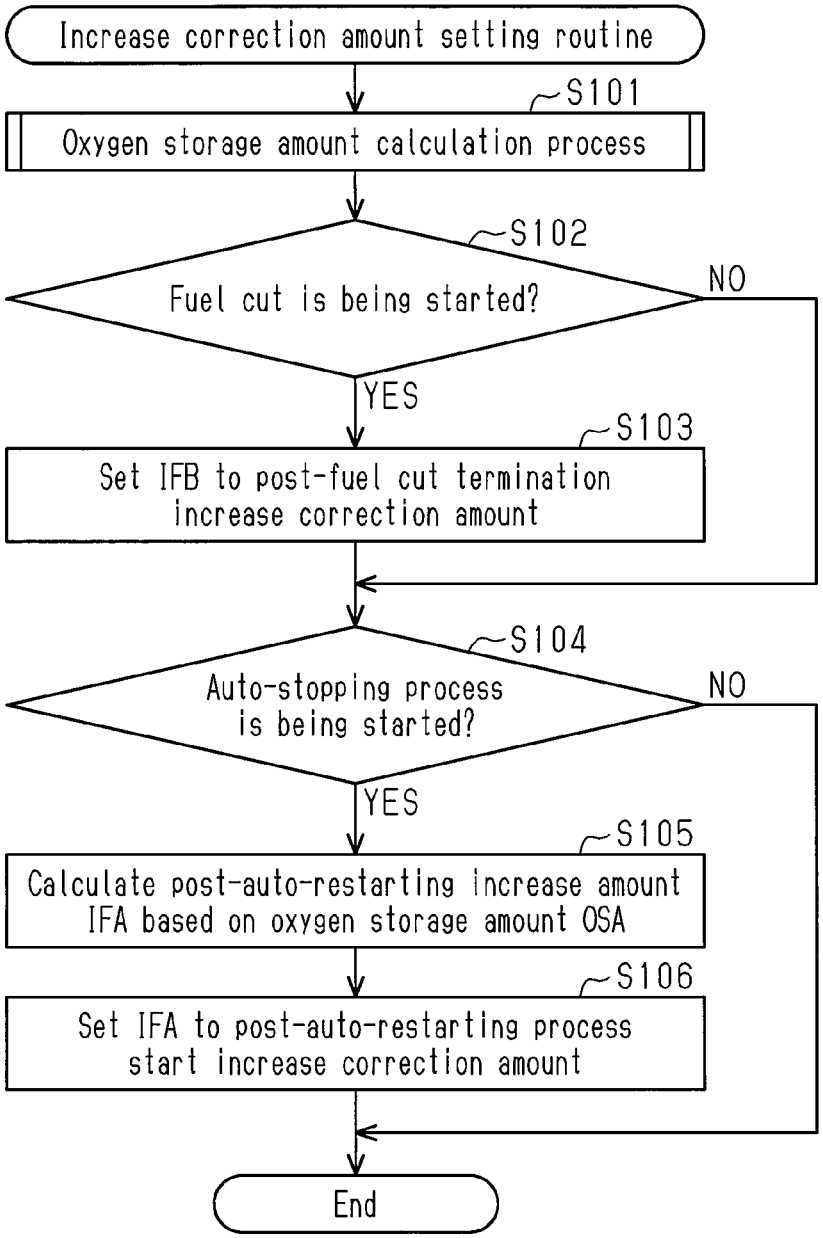
FIG. 4 is a flowchart showing the procedures for variably setting the increase correction amount for the fuel injection amount after the auto-restarting process is started.

FIG. 4 is a flowchart showing an increase correction amount setting routine, in which the increase correction amount of the fuel injection in the internal combustion engine 1 is set. The increase correction amount setting routine, which may be an interrupt per predetermined time, is cyclically executed by the electronic control unit 21.

As the process of step 101 (S101) in the routine, the electronic control unit 21 calculates the oxygen storage amount OSA of the three-way catalyst. Then, as the process of step S102, the electronic control unit 21 determines whether or not fuel cut is being started. If a negative determination is given, the electronic control unit 21 proceeds to S104. If an affirmative determination is given, the electronic control unit 21 proceeds to S103. As the process of S103, the electronic control unit 21 sets the post-fuel cut termination increase amount IFB, which is determined in advance through experiments or the like, to the increase correction amount of the fuel injection after fuel cut is terminated. Then, the electronic control unit 21 proceeds to S104.

As the process of S104, the electronic control unit 21 determines whether or not the auto-stopping process of the internal combustion engine 1 is being started. If a negative determination is given, the increase correction amount setting routine is temporarily terminated. If an affirmative determination is given, the electronic control unit 21 proceeds to S105. As the process of S105, the electronic control unit 21 calculates the post-auto-restarting increase amount IFA based on the oxygen storage amount OSA calculated in S101, that is, the oxygen storage amount OSA at a point of time when the above auto-stopping process is started. The post-auto-restarting increase amount IFA, which is calculated in this manner, varies in accordance with the oxygen storage amount OSA at the point of time when the auto-stopping process is started, for example, as shown in FIG. 2. Subsequently, as the process of S106, the electronic control unit 21 sets the calculated post-auto-restarting increase amount IFA to the increase correction amount of the fuel injection after the auto-restarting process of the internal combustion engine 1 is started. Then, the electronic control unit 21 temporarily terminates the increase correction amount setting routine.

Figure 5:
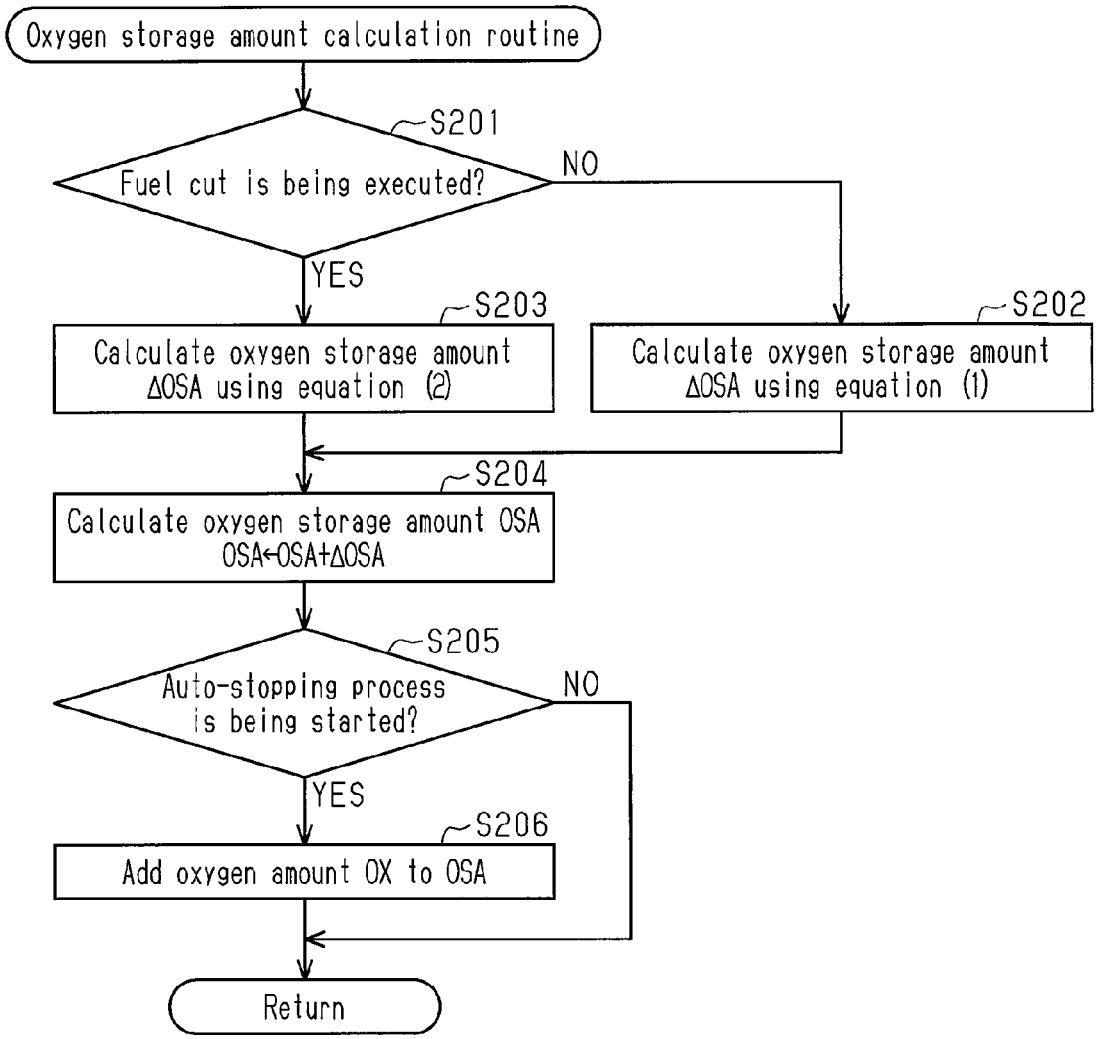
FIG. 5 is a flowchart showing the procedures for calculating the oxygen storage amount of the three-way catalyst.

FIG. 5 is a flowchart showing an oxygen storage amount calculation routine that is executed for executing the oxygen storage amount calculation process of S101 in the increase correction amount setting routine of FIG. 4. The electronic control unit 21 executes the oxygen storage amount calculation routine each time proceeding to S101 of the increase correction amount setting routine of FIG. 4.

As the process of S201 in the routine, the electronic control unit 21 determines whether or not fuel cut is being performed. If a negative determination is given, the electronic control unit 21 proceeds to S202. As the process of S202, the electronic control unit 21 calculates the oxygen storage amount ΔOSA per short time using equation (1) described above. If an affirmative determination is given in S201, the electronic control unit 21 proceeds to S203. As the process of S203, the electronic control unit 21 calculates the oxygen storage amount ΔOSA per short time using equation (2) described above.

The execution interval of the oxygen storage amount calculation routine, that is, the time interval when the process of S101 in the increase correction amount setting routine is executed, is used as the short time of the process of each of S202 and S203. After executing the process of S202 or S203, the electronic control unit 21 proceeds to S204. As the process of S204, the electronic control unit 21 calculates the oxygen storage amount OSA by accumulating the oxygen storage amount ΔOSA per short time whenever the short time elapses. The oxygen storage amount OSA is an estimated value of the total amount of oxygen stored in the three-way catalyst.

As the process of S205, the electronic control unit 21 determines whether or not the auto-stopping process is being started. If a negative determination is given, the electronic control unit 21 temporarily terminates the oxygen storage amount calculation routine. When the oxygen storage amount calculation routine is terminated in this manner, the electronic control unit 21 returns to S101 of the increase correction amount setting routine in FIG. 4. If an affirmative determination is given in S205, the electronic control unit 21 proceeds to S206 of FIG. 5. As the process of S206, the electronic control unit 21 adds the amount of oxygen (oxygen amount OX) stored in the three-way catalyst during the inertial rotation of the internal combustion engine 1 from when the auto-stopping process is started to when the engine 1 is completely stopped. Then, the electronic control unit 21 returns to S101 in the increase correction amount setting routine of FIG. 4. When the oxygen storage amount calculation routine is terminated in this manner, the electronic control unit 21 returns to S101 of the increase correction amount setting routine in FIG. 4.

Figure 6:
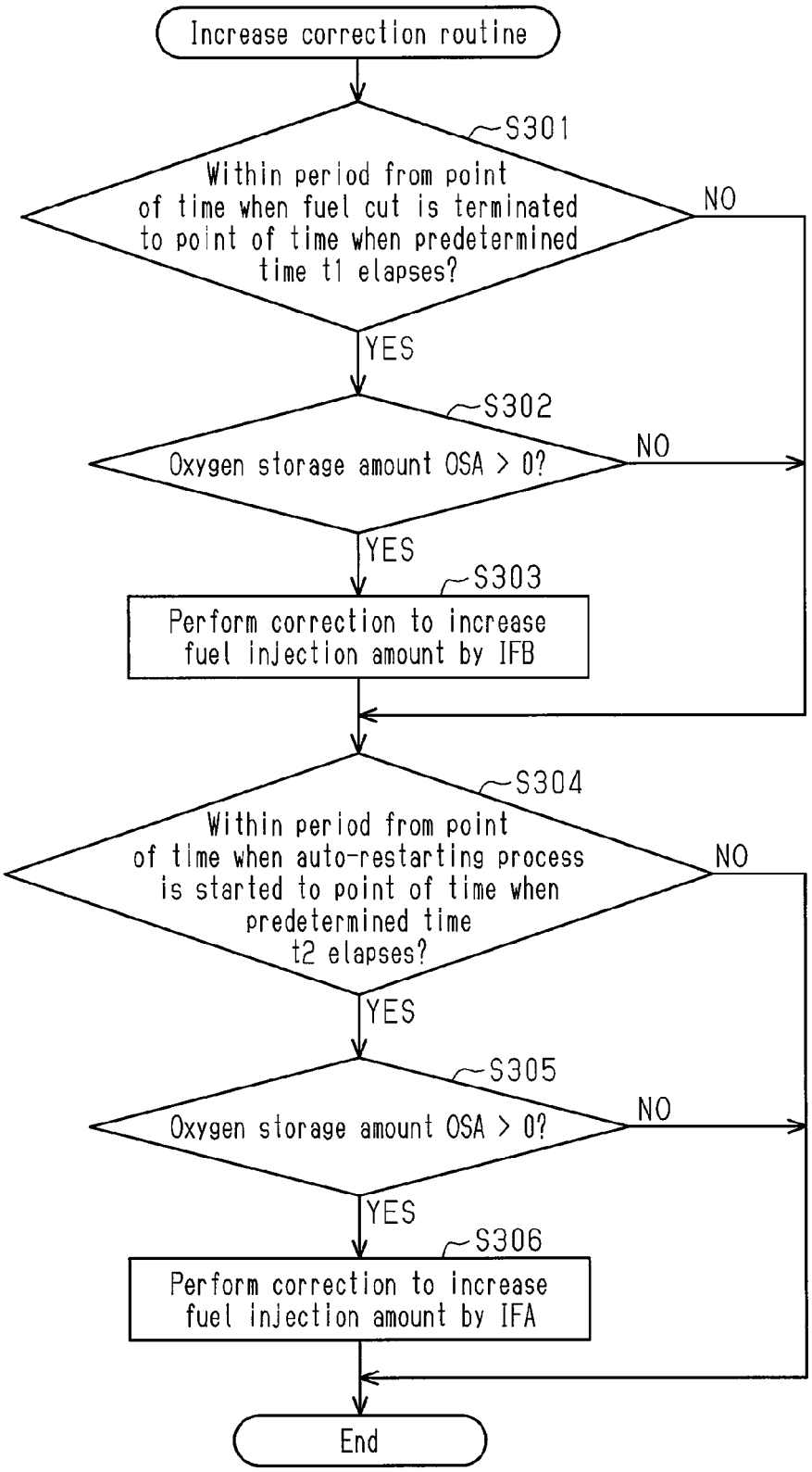
FIG. 6 is a flowchart showing the procedures for performing a correction that increases the fuel injection amount.

FIG. 6 is a flowchart showing an increase correction routine for performing an increase correction on the fuel injection amount. The electronic control unit 21 cyclically executes the increase correction routine, which may be an interrupt per predetermined time.

As the process of S301, the electronic control unit 21 determines whether or not fuel cut has been terminated, that is, it is within a period from a point of time when fuel cut is terminated to a point of time when a predetermined time t1 elapses. If an affirmative determination is given, the electronic control unit 21 proceeds to S302. As the process of S302, the electronic control unit 21 determines whether or not the oxygen storage amount OSA is currently greater than "zero". If an affirmative determination is given, the electronic control unit 21 proceeds to S303. As the process of S303, the electronic control unit 21 performs the correction to increase the fuel injection amount by the post-fuel cut termination increase amount IFB after fuel cut is terminated, more specifically, during the period from the point of time when fuel cut is terminated to the point of time when the predetermined time t1 elapses.

The above predetermined time t1 is set in advance through experiments or the like as a time sufficient for the amount of oxygen stored in the three-way catalyst to reach "zero" through the correction that increases the fuel injection amount and is performed from the point of time when fuel cut is terminated.

When a negative determination is given in S301 or S302, the electronic control unit 21 does not perform the correction to increase the fuel injection amount by the post-fuel cut termination increase amount IFB and proceeds to S304. Thus, after the correction to increase the fuel injection amount by the post-fuel cut termination increase amount IFB is performed when fuel cut is terminated, if the predetermined time t1 elapses from the point of time when fuel cut is terminated (S301: NO), the correction to increase the fuel injection amount by the post-fuel cut termination increase amount IFB is terminated. Also, during the period from the point of time when fuel cut is terminated to the point of time when the predetermined time t1 elapses, if the oxygen storage amount OSA is decreased to "zero" due to the correction to increase the fuel injection amount by the post-fuel cut termination increase amount IFB (S302: NO), the above increase correction is terminated.

As the process of S304, the electronic control unit 21 determines whether or not the auto-restarting process has been performed on the internal combustion engine 1, that is, it is within a period from a point of time when the auto-restarting process is started to a point of time when a predetermined time t2 elapses. If an affirmative determination is given, the electronic control unit 21 proceeds to S305. As the process of S305, the electronic control unit 21 determines whether or not the oxygen storage amount OSA is currently greater than "zero". If an affirmative determination is given, the electronic control unit 21 proceeds to S306. As the process of S306, the electronic control unit 21 performs the correction to increase the fuel injection amount by the post-auto-restarting increase amount IFA after the auto-restarting process is started, more specifically, during the period from the point of time when the auto-restarting process is started to the point of time when the predetermined time t2 elapses.

The above predetermined time t2 is set in advance through experiments or the like as a time sufficient for the amount of oxygen stored in the three-way catalyst to reach "zero" through the correction that increases the fuel injection amount and is performed from the point of time when the auto-restarting process is started.

When a negative determination is given in S304 or S305, the electronic control unit 21 does not perform the correction to increase the fuel injection amount by the post-auto-restarting increase amount IFA and temporarily terminates the increase correction routine. Thus, after the increase correction of the fuel injection amount is performed when the auto-restarting process is started, if the predetermined time t2 elapses from the point of time when the auto-restarting process is started (S304: NO), the increase correction of the fuel injection amount is terminated. Also, during the period from the point of time when the auto-restarting process is started to the point of time when the predetermined time t2 elapses, if the oxygen storage amount OSA is decreased to "zero" through the increase correction of the fuel injection amount (S305: NO), the above increase correction is terminated.

The present embodiment, which has been described in detail, has the advantages described below.

(1) At a point of time when the auto-stopping process is started, the oxygen storage amount OSA of the three-way catalyst would vary in accordance with the engine running state until the auto-stopping process is started. This forms variations in the oxygen storage amount OSA at a point of time when the auto-restarting process of the internal combustion engine 1 is started. To solve this problem, the increase correction amount of the fuel injection after the auto-restarting process is started (post-auto-restarting increase amount IFA) may be changed based on the oxygen storage amount OSA at a point of time when the auto-stopping process is started so that the post-auto-restarting increase amount IFA is set to a value suitable for the oxygen storage amount OSA after the auto-restarting process is started. This allows the exhaust purification function of the three-way catalyst to be appropriately maintained after the auto-restarting process is started. More specifically, deteriorations in the HC, CO removal performance of the three-way catalyst, which would occur when the increase correction amount is excessively large relative to the oxygen storage amount OSA, may be limited. Also, deteriorations in the NOx removal performance of the three-way catalyst, which would occur when the increase correction amount is excessively small relative to the oxygen storage amount OSA, may be limited.

(2) After the normal running of the internal combustion engine 1 is started again when fuel cut is terminated, the oxygen storage amount OSA of the three-way catalyst is gradually decreased through the increase correction of the fuel injection amount of the engine 1. After the oxygen storage amount OSA starts decreasing in this manner, when the auto-stopping process of the internal combustion engine 1 is started, the oxygen storage amount OSA at a point of time when the auto-stopping process is started varies in accordance with the length of time from when fuel cut is terminated to when the auto-stopping process is started. Accordingly, the oxygen storage amount OSA varies after the auto-restarting process is started. Thus, the oxygen storage amount OSA tends to largely vary when the auto-restarting process is started. However, even under such a condition, the increase correction amount of the fuel injection after the auto-restarting process is started (post-auto-restarting increase amount IFA) may be adjusted to a value suitable for the oxygen storage amount OSA of the three-way catalyst after the auto-restarting process is started.

(3) The oxygen storage amount OSA of the three-way catalyst is obtained as an estimated value of the total amount of oxygen stored in the three-way catalyst by accumulating the oxygen storage amount ΔOSA, which is the amount of oxygen stored in the three-way catalyst within a short time, whenever the short time elapses. When fuel cut is not performed while the engine is running, the oxygen storage amount ΔOSA per short time is calculated based on the air-fuel ratio and the fuel injection amount Q and using equation (1). When fuel cut is executed, the oxygen storage amount ΔOSA per short time is calculated based on the intake air amount GA and using equation (2). This allows the oxygen storage amount OSA of the three-way catalyst to be appropriately calculated when fuel cut is not performed while the engine is running and when fuel cut is executed.

(4) If the oxygen storage amount OSA is greater than "zero" (if oxygen is stored in three-way catalyst) when the auto-stopping process is started, the post-auto-restarting increase amount IFA is increased from that used when the oxygen storage amount OSA is "zero" (when oxygen is not stored in three-way catalyst). At the point of time when the auto-stopping process is started, when oxygen is stored in the three-way catalyst, the oxygen storage amount OSA at the point of time when the auto-restarting process is started is larger than when oxygen is not stored in the catalyst. To cope with this, the post-auto-restarting increase amount IFA may be increased. If the post-auto-restarting increase amount IFA is not increased, when the correction to increase the fuel injection amount by the post-auto-restarting increase amount IFA is performed, the removal of oxygen, which is used to oxidize HC, CO in the exhaust gas, from the three-way catalyst would be decreased. This hinders reduction of the amount of oxygen stored in the catalyst and may deteriorate the NOx removal performance of the catalyst. However, such a deterioration in the NOx removal performance of the three-way catalyst may be limited when the post-auto-restarting increase amount IFA is increased as described above.

(5) As the oxygen storage amount OSA increases when the auto-stopping process is started, the increase correction amount of the fuel injection after the auto-restarting process is started (post-auto-restarting increase amount IFA) is increased. As the oxygen storage amount OSA increases when the auto-stopping process is started, the oxygen storage amount OSA increases when the auto-restarting process is started. To cope with this, the increase correction amount of the fuel injection after the auto-restarting process is started (post-auto-restarting increase amount IFA) may be increased. In contrast, as the oxygen storage amount OSA is decreased when the auto-stopping process is started, the oxygen storage amount OSA is decreased when the auto-restarting process is started. To cope with this, the increase correction amount of the fuel injection after the auto-restarting process is started (post-auto-restarting increase amount IFA) may be decreased. If the post-auto-restarting increase amount IFA is not adjusted in this manner, the post-auto-restarting increase amount IFA would be excessively large or small relative to the oxygen storage amount OSA. However, the adjustment of the post-auto-restarting increase amount IFA in the above manner limits deteriorations in the HC, CO removal performance of the three-way catalyst, which would occur when the post-auto-restarting increase amount IFA is excessively large, and in the NOx removal performance of the three-way catalyst, which would occur when the post-auto-restarting increase amount IFA is excessively small.

It should be apparent to those skilled in the art that the present invention may be embodied in many other specific forms without departing from the scope of the invention. Particularly, it should be understood that the present invention may be embodied in the following forms.

The increase correction amount of the fuel injection after the auto-restarting process is started may be changed in accordance with changes in the air-fuel ratio and the fuel injection amount until the auto-stopping process is started. More specifically, based on the changes in the air-fuel ratio and the fuel injection amount until the auto-stopping process is started, a parameter is obtained in correspondence with the present actual oxygen storage amount of the three-way catalyst. Then, the increase correction amount of the fuel injection after the auto-restarting process is started is changed based on the parameter at the point of time when the auto-stopping process is started. In this manner, when the increase correction amount of the fuel injection after the auto-restarting process is started is changed, the increase correction amount of the fuel injection after the auto-restarting process is started may be adjusted to a value suitable for the oxygen storage amount of the three-way catalyst at the corresponding time even when variations in the oxygen storage amount of the three-way catalyst at the point of time when the auto-stopping process is started cause variations in the oxygen storage amount of the three-way catalyst at the point of time when the auto-restarting process is started. When the increase correction amount of the fuel injection after the auto-restarting process is started is adjusted to the value suitable for the oxygen storage amount of the three-way catalyst at the corresponding time, the exhaust purification performance of the three-way catalyst may be appropriately maintained after the auto-restarting process is started.

The increase correction amount of the fuel injection after the auto-restarting process is started (post-auto-restarting increase amount IFA) may be increased in a stepped manner, instead of gradual manner, as the oxygen storage amount OSA increases when the auto-stopping process is started.

The condition for executing the auto-stopping process and the condition for executing the auto-restarting process may be appropriately modified.

When the oxygen storage amount OSA is greater than "zero" (oxygen is stored in three-way catalyst) at a point of time when the auto-stopping process is started, the post-auto-restarting increase amount IFA may be fixed to the optimal value determined in advance through experiments or the like.

Fuel cut control does not necessarily have to be executed. When fuel cut control is not executed, the oxygen storage amount ΔOSA per short time does not need to be calculated using equation (2). This reduces the calculation load of the electronic control unit 21.

When fuel cut control is executed, the oxygen storage amount OSA (oxygen storage amount ΔOSA) does not necessarily have to be always calculated. For example, when fuel cut is started, the calculation for the oxygen storage amount OSA (oxygen storage amount ΔOSA) may be started with the initial value being "zero". Subsequently, the calculation for the oxygen storage amount OSA (oxygen storage amount ΔOSA) may be continued until a predetermined time elapses from the point of time when the auto-restarting process is started.

The condition for executing fuel cut and the condition for terminating fuel cut may be appropriately modified.

Therefore, the present examples and embodiments are to be considered as illustrative and not restrictive and the invention is not to be limited to the details given herein, but may be modified within the scope and equivalence of the appended claims.

The invention claimed is:

1. A controller for an internal combustion engine mounted on a vehicle, wherein the engine includes an exhaust passage provided with a catalyst, the controller comprising:

a processor, wherein the processor is configured to perform an auto-stopping process on the engine when the engine is idling, perform an auto-restarting process on the engine when the engine is automatically stopped, correct an amount of fuel injected into the engine so that the fuel injection amount of the engine is increased by a correction amount after the auto-restarting process is started, and change the correction amount in accordance with an amount of oxygen stored in the catalyst at a point of time when the auto-stopping process is started.

2. The controller according to claim 1, wherein the processor is configured to execute fuel cut that stops supplying fuel to the engine when a speed of the vehicle is decreased, and correct the fuel injection amount so that the fuel injection amount is increased by a second correction amount after execution of the fuel cut is terminated.

3. The controller according to claim 2, wherein the processor is configured to determine the second correction amount in accordance with an increase in the oxygen storage amount of the catalyst in a period during the execution of the fuel cut.

4. The controller according to claim 2, wherein the processor is configured to obtain an oxygen storage amount of the catalyst based on an air-fuel ratio of an air-fuel mixture supplied to the engine and the fuel injection amount when the fuel cut is not executed while the engine is running, and obtain the oxygen storage amount based on an intake air amount of the engine when the fuel cut is executed.

5. The controller according to claim 1, wherein if oxygen is stored in the catalyst when the auto-stopping process starts, the processor is configured to increase the correction amount from the correction amount that is used when oxygen is not stored in the catalyst.

6. The controller according to claim 5, wherein the processor is configured to increase the correction amount as the oxygen storage amount of the catalyst increases at a point of time when the auto-stopping process is started.

7. A controller for an internal combustion engine mounted on a vehicle, wherein the engine includes an exhaust passage provided with a catalyst, the controller comprising:

a processor, wherein the processor is configured to perform an auto-stopping process on the engine when the engine is idling, perform an auto-restarting process on the engine when the engine is automatically stopped, correct an amount of fuel injected into the engine so that the fuel injection amount of the engine is increased by a correction amount after the auto-restarting process is started, and change the correction amount in accordance with changes in an air-fuel ratio of an air-fuel mixture, which is supplied to the engine, and changes in a fuel injection amount during a period between when a fuel cut is terminated and when the auto-stopping process is started.

* * * * *